United States Patent [19]

Smith et al.

[11] Patent Number: 5,062,549

[45] Date of Patent: Nov. 5, 1991

[54] HAND HELD, DIP-TUBE STYLE LIQUID DISPENSER

[75] Inventors: David A. Smith, Midland; Clark M. Woody, Bay City, both of Mich.

[73] Assignee: DowBrands Inc., Indianapolis, Ind.

[21] Appl. No.: 431,418

[22] Filed: Nov. 3, 1989

[51] Int. Cl.[5] ..... B67D 5/40

[52] U.S. Cl. ..... 222/377; 222/382; 222/464

[58] Field of Search ..... 222/382, 464, 211, 377, 222/321, 383

[56] References Cited

U.S. PATENT DOCUMENTS

| | | | |
|---|---|---|---|
| 847,760 | 3/1907 | Gates | 222/382 X |
| 1,530,074 | 3/1925 | Eckert | 222/382 X |
| 1,724,378 | 8/1929 | Stokstad | 222/464 X |
| 2,002,635 | 5/1935 | Kinney | 222/211 X |
| 2,294,858 | 9/1942 | Allen | 222/464 |
| 2,324,648 | 7/1943 | Roeder | 222/464 |
| 2,695,121 | 11/1954 | Daniels | 222/382 X |
| 2,805,795 | 9/1957 | Barnes | 222/464 X |
| 2,837,245 | 6/1958 | Grebowiec | 222/402.1 |
| 2,869,762 | 1/1959 | Sanders | 222/382 |
| 2,889,964 | 6/1959 | Cooprider | 222/321 |
| 3,083,875 | 4/1963 | Welty et al. | 222/464 X |
| 3,171,571 | 3/1965 | Daniels | 222/464 X |
| 3,229,863 | 1/1966 | Scoggin, Jr. et al. | 222/321 |
| 3,319,834 | 5/1967 | Steele | 222/464 X |
| 4,257,539 | 3/1981 | Cary et al. | 222/383 X |
| 4,461,406 | 7/1984 | Vannucci | 222/211 |
| 4,470,526 | 9/1984 | Cha et al. | 222/382 X |
| 4,762,241 | 8/1988 | Lang | 215/250 |
| 4,819,835 | 4/1989 | Tasaki | 222/383 |
| 4,830,235 | 5/1989 | Miller | 222/464 |

FOREIGN PATENT DOCUMENTS

| | | | |
|---|---|---|---|
| 301174 | 9/1965 | Netherlands | 222/402.1 |

*Primary Examiner*—Kevin P. Shaver

[57] ABSTRACT

A hand held, dip-tube style liquid spray dispenser comprising a container having an inclined bottom, sidewalls extending upwardly from the bottom, and an upper end, a dispensing device positioned adjacent this upper end for dispensing a liquid held in the container and communicated upward to the dispensing device, and a tube for communicating liquid upward from a lower end of the tube to the dispensing device. The tube being of a sufficient length such that the lower end of the tube is urged toward the lowermost portion of the bottom when the container is oriented as in use.

6 Claims, 3 Drawing Sheets

HAND HELD, DIP-TUBE STYLE LIQUID DISPENSER

BACKGROUND OF THE INVENTION

The present invention relates to hand held dispensing apparatus for liquids, and more particularly to hand held, dip-tube style liquid dispensers. In another aspect, the invention relates to an improvement in hand held, dip-tube style spray dispensers for liquids.

Dip-tube style dispensers and dip-tube style spray dispensers for liquids particularly have widespread consumer acceptance and appeal. Such hand held dispensers are used for dispensing a variety of liquids and for a variety of uses, from dispensing cleaning products to dispensing water to house plants. Uniformly, however, the tilting or inclination of containers for these dispensers in use and the placement of a lower end of the dip-tube are such that before all of the liquid is evacuated from a container, prime is lost and the user of the device must remove and perhaps apply or use the remaining liquid in some less convenient or efficacious way. The necessity of undertaking to remove the remaining liquid, which may or may not be substantial in volume, naturally has the effect of reducing the appeal of such dip-tube style dispensers for liquids.

SUMMARY OF THE PRESENT INVENTION

The present invention addresses this problem by providing an improved hand held dispenser for liquids which comprises: a container having a bottom which is inclined with respect to the horizontal, sidewalls extending upwardly from the inclined bottom, and an upper end: dispensing means positioned adjacent the upper end of the container for dispensing a liquid held in the container and communicated upward to the dispensing means: and a tube for communicating the liquid upward from a lower end of the tube to the dispensing means. The tube is of a sufficient length such that the lower end of the tube is urged toward the lowermost portion of the bottom when the container is oriented as in use.

DETAILED DESCRIPTION OF THE PREFERRED EMBODIMENTS

Figure 1:
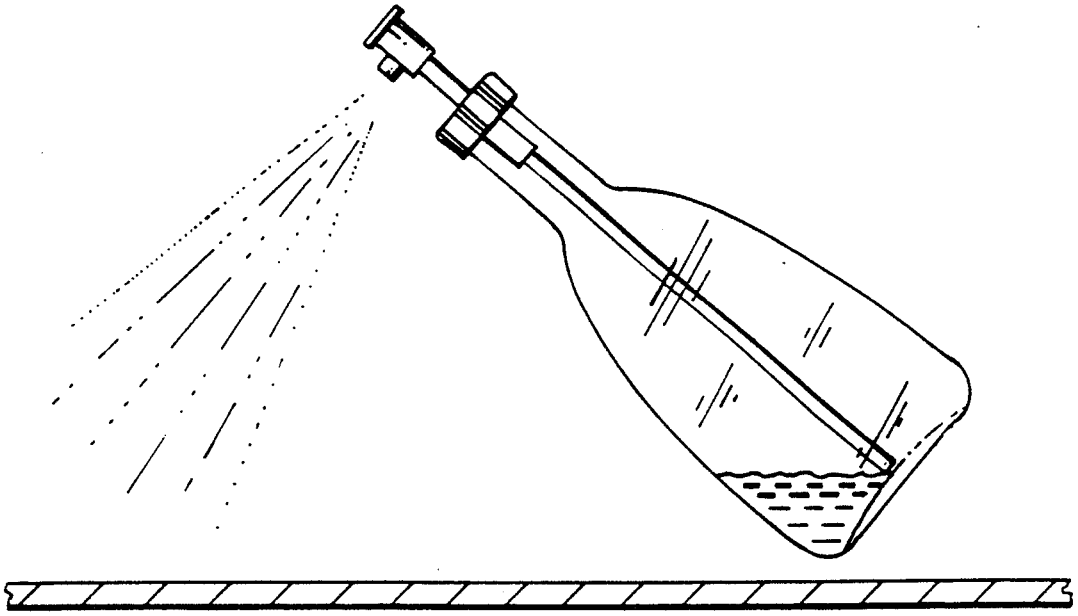
FIG. 1 depicts a typical hand held, dip-tube style liquid spray dispenser of the prior art.
Figure 2:
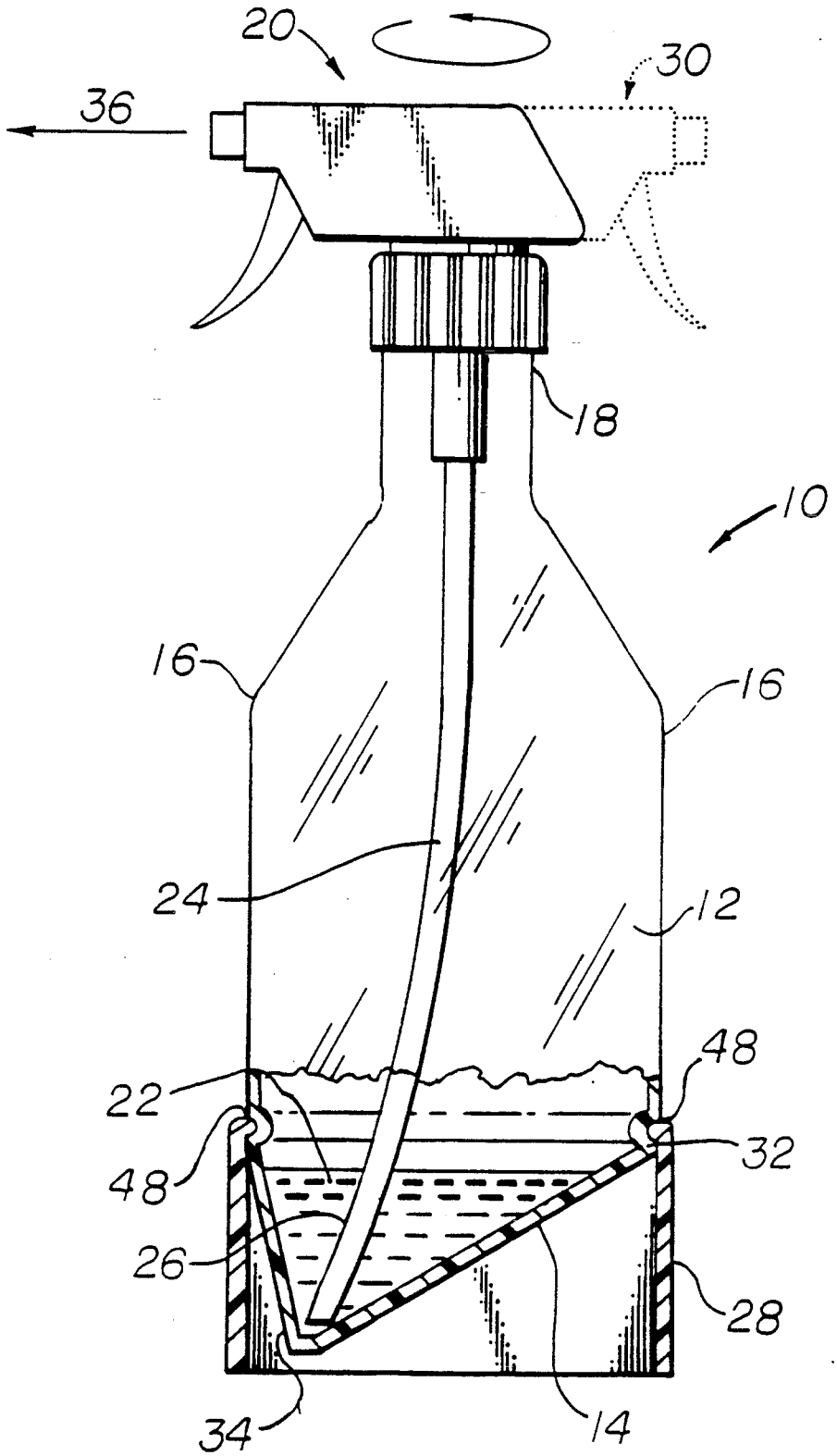
FIG. 2 is a partial cross-sectional view of a preferred embodiment of the present invention.

Referring now to the drawings, and more particularly to FIGS. 1 and 2, a preferred embodiment of a hand held dip-tube style spray dispenser of the present invention is shown and generally designated by the numeral 10. In FIG. 2 it can be seen that the dispenser 10 generally comprises a container 12 having an inclined bottom 14, sidewalls 16 extending upwardly from the bottom 14 and an upper end 18, dispensing means 20 positioned adjacent the upper end 18 of the container 12 for dispensing a liquid 22 held in the container 12 and communicated upward to the dispensing means 20, and a tube 24 for communicating the liquid 22 upward from a lower end 26 of the tube 24 to the dispensing means 20. The dispenser shown in FIG. 2 also is provided with a support means 28 for supporting the container 12 in a substantially upright position when not in use.

The dispensing means 20 of the preferred embodiment of FIG. 2 comprises a conventional trigger-type spray mechanism which may be pivoted to the position 30 shown in phantom in FIG. 2, corresponding roughly to a 180° turn from the original position of the spray mechanism. The purpose behind this feature will be explained subsequently in conjunction with FIG. 4.

The bottom 14 may be generally described as inclined in a direction which approximately coincides with the direction in which the liquid 22 is to be dispensed, from an uppermost intersection 32 of the bottom 14 and of the sidewalls 16 of the container 12 to a lowermost intersection 34 of the bottom 14 and sidewalls 16, with the lower end 26 of the tube 24 located adjacent to the lowermost intersection 34. The direction in which the liquid 22 is to be dispensed is suggested by the arrow 36.

When the spray mechanism 20 of the dispenser 10 occupies the position 30, however, the direction of the incline of the bottom 14 from the uppermost intersection 32 to the lowermost intersection 34 is generally diametrically opposed to the direction in which the liquid 22 is to be dispensed.

Figure 3:
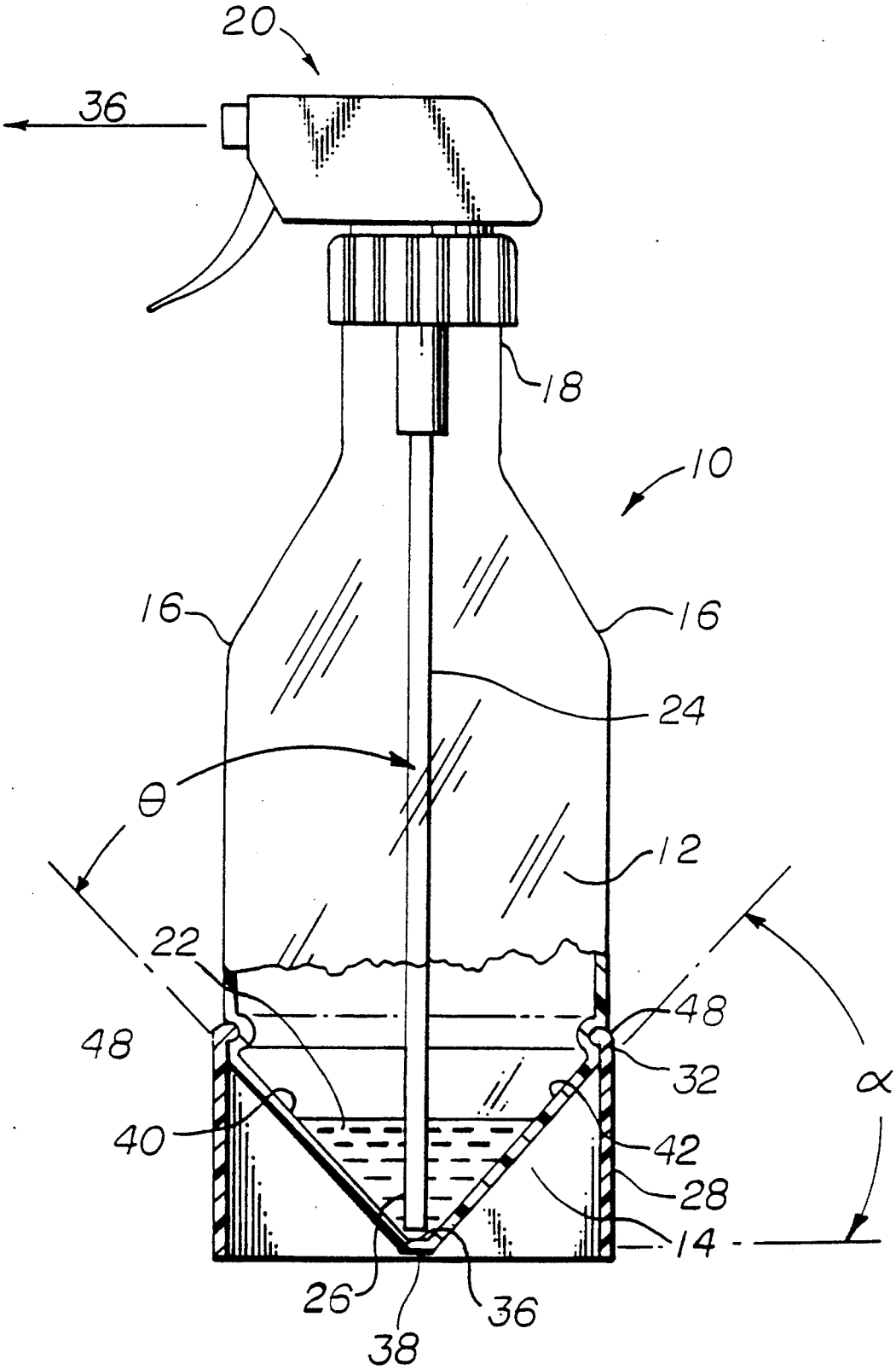
FIG. 3 is a partial cross-sectional view of an alternative preferred embodiment of the present invention.

An alternative embodiment of the hand held, dip-tube style liquid dispenser of the present invention is shown in FIG. 3, and also comprises a container 12 having an inclined bottom 14, sidewalls 16 extending upwardly from the bottom 14, and an upper end 18, dispensing means 20 such as the trigger-type spray mechanism shown for dispensing a liquid 22, and a tube 4 for communicating the liquid 22 from a lower end 26 of the tube 24 to the trigger-type spray mechanism 20. A support means 28 is also provided, as before.

The primary difference between the embodiments of FIGS. 2 and 3 which must be noted is the shape of the bottom 14. In the embodiment shown in FIG. 3, the bottom 14 is generally V-shaped, and the lower end 26 of the tube 24 is located roughly adjacent the lowermost portion 36 of the bottom 14, or adjacent the bottom of the trough 38 which is defined by the V-shaped bottom 14. As shown, the tube 24 forms an angle $\theta$ with a portion 40 of the V-shaped bottom 14, and a second portion 42 of the V-shaped bottom 14 forms an angle $\alpha$ with respect to the horizontal.

Figure 4:
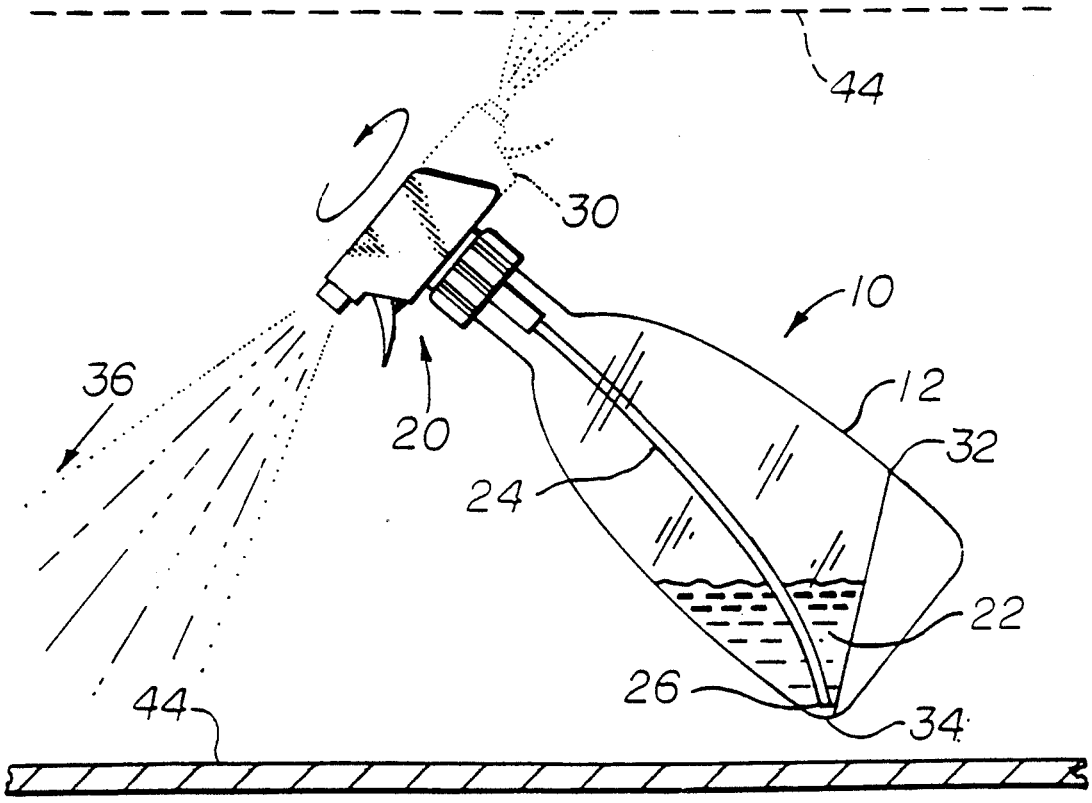
FIG. 4 depicts a side view of the preferred embodiment of FIG. 2 as oriented in use.

Referring now to FIG. 4, a discussion of the operation of the dispensers of FIGS. 2 and 3 may be undertaken, although only the dispenser shown in FIG. 2 is specifically illustrated. As shown, the dispenser 10 is poised above a surface 44 which is to be sprayed with a liquid 22 dispensed from the container 12, or where the dispensing means 20 is in the position 30 shown in phantom, the dispenser 10 is poised below such a surface 44. Whether the dispenser 10 is oriented as in use and the dispensing means 20 properly positioned for spraying liquid 22 downward onto a surface 44 or upward onto a surface 44, it can be clearly seen that the lower end 26 of the tube 24 is positioned adjacent the lowermost portion 36 of the bottom 14.

In general, it is desired that the tube 24 be of a sufficient length such that its lower end 26 is urged towards this position. Where the tube 24 has a given degree of rigidity, it should be apparent that the length of the tube 24 and the slope of the bottom 14 are to be selected such that the path of least resistance for the lower end 26 of the tube 24 is to follow the slope of the bottom 14 toward the lowermost portion 36 of the bottom 14.

With regard to the dispenser 10 shown in FIG. 4 and in more detail in FIG. 2, two additional observations may be appropriate. First, if the dispensing means 20 of that dispenser 10 is not movable from its original position to the position 30 shown in phantom so that the dispenser must itself be inverted to spray upward onto a surface 44, the slope of the bottom 14 must be such that the bottom 14 still retains something of an inclined condition with respect to the horizontal from the intersection 32 to the intersection 34 if prime is not to be prematurely lost.

The ability of the dispensing means 20 to move to a position 30 thus enables the user of the dispenser 10 to take advantage of the slope of the bottom 14 when spraying upward as well as downward. As a second observation, the lowermost portion 36 of the bottom 14 in this particular configuration is generally always the intersection 34.

This is in contrast with the dispenser shown in FIG. 3, wherein the lowermost portion 36 will generally be the bottom of the trough 38 defined by the V-shaped bottom 14. It may not be possible in all circumstances to ascertain where the bottom 14 ends and the sides 16 begin, or to differentiate between a lowermost portion 36 of the bottom 14 and a lowermost intersection 34 of the bottom 14 and sidewalls 16. It is sufficient for purposes of the present invention if the lower end 26 of the tube 24 is urged toward a position wherein the last of the liquid 22 in the container 12 would collect, when the dispenser 10 is oriented as in use. Any configuration which satisfies this description should be considered an equivalent for purposes of meeting this particular limitation in the claims that follow.

It will be seen that the placement of the lower end 26 of the tube 24 and the nature of the bottom 14 of the dispenser shown in FIG. 3 will permit the dispenser to be used in spraying liquid 22 either downward or upward, without pivoting the dispensing means 20 from one position to another. In spraying downward, the shape of the bottom 14 should be such that the increase in the angle $\alpha$ defined by the second portion 42 of the bottom 14 and the horizontal must not exceed the difference between 90° and $\theta$, and in spraying upward the angle c must not decrease to 0° or less.

While preferred embodiments of the preferred hand held, dip-tube style dispenser of the present invention have been described, numerous changes in the construction and design of the dispensers described above may be made without departing from the scope of the present invention as defined by the appended claims. For example, the support means 28 may be integrally formed with the container 12, rather than the support means 28 being snapped into place at recesses 48 formed in the sides 16 of container 12 or glued into position. Or, instead of a trigger-type sprayer mechanism, the dispensing means 20 may comprise a conventional plunger-type spray mechanism. It is believed, however, that in terms of the utility of these devices and of ease, expense and reliability of manufacture, it will usually be preferable to use a two-piece construction of the container 12 and support means 28.

What is claimed is:

1. An improved hand held, non-pressurized dispenser for liquids, comprising:

a container having an inclined bottom, sidewalls extending upwardly from said bottom, and an upper end;

dispensing means positioned adjacent said upper end of said contain for dispensing a liquid held in said container and communicated upward to said dispensing means;

a tube for communicating said liquid upward from a lower end of said tube to said dispensing means, said tube being of a sufficient length such that said lower end of said tube is urged by the inclined bottom towards a lowermost portion of said bottom when said container is oriented as in use; and support means fastened to said container for supporting said container in a substantially upright position when not in use.

2. An improved hand held dispenser as defined in clam 1, wherein said lower end of said tube is positioned adjacent said lowermost portion of said bottom.

3. An improved hand held dispenser as defined in claim 1, wherein said bottom is V-shaped.

4. An improved hand held dispenser as defined in claim 1, wherein said dispensing means comprises a plunger-type spray mechanism.

5. An improved hand held dispenser as defined in claim 1, wherein said dispensing means comprises a trigger-type spraying mechanism.

6. An improved hand held dispenser as defined in claim 1, wherein said dispensing means is pivotable from a first position, characterized in that said bottom of said container is inclined from an uppermost intersection of said bottom and said sidewalls of said container to a lower most intersection thereof in a direction which approximately coincides with the direction in which said liquid is to be dispensed, to a second position wherein said bottom is inclined from said uppermost intersection to said lowermost intersection in a direction which diametrically opposes the direction in which the liquid is to be dispensed.

* * * * *

UNITED STATES PATENT AND TRADEMARK OFFICE

CERTIFICATE OF CORRECTION

PATENT NO. : 5,062,549

DATED : November 5, 1991

INVENTOR(S) : David A. Smith; Clark M. Woody

It is certified that error appears in the above-identified patent and that said Letters Patent is hereby corrected as shown below:

Column 4, Line 18 "contain" should read --container--

Signed and Sealed this

Sixth Day of July, 1993

*Attest:*

Michael K. Kirk

MICHAEL K. KIRK

*Attesting Officer*

*Acting Commissioner of Patents and Trademarks*